US007153103B2

(12) United States Patent
Farndon

(10) Patent No.: US 7,153,103 B2
(45) Date of Patent: Dec. 26, 2006

(54) FAN BLADE AND DISK ASSEMBLY

(75) Inventor: Robert J Farndon, Derby (GB)

(73) Assignee: Rolls-Royce plc, London (GB)

( * ) Notice: Subject to any disclaimer, the term of this patent is extended or adjusted under 35 U.S.C. 154(b) by 75 days.

(21) Appl. No.: 11/028,181

(22) Filed: Jan. 4, 2005

(65) Prior Publication Data

US 2005/0271510 A1 Dec. 8, 2005

(30) Foreign Application Priority Data

Jan. 29, 2004 (GB) ..... 0402061.6

(51) Int. Cl.
*F01D 5/32* (2006.01)

(52) U.S. Cl. ..... 416/221; 416/245 R

(58) Field of Classification Search ..... 416/219 R, 416/220 R, 221, 245 R, 245 A
See application file for complete search history.

(56) References Cited

U.S. PATENT DOCUMENTS 3,598,503 A * 8/1971 Muller ..... 416/221
5,443,366 A * 8/1995 Knott et al. ..... 416/221
6,447,255 B1 * 9/2002 Bagnall et al. ..... 416/245 R
6,561,763 B1 * 5/2003 Breakwell ..... 416/245 R
6,837,686 B1 * 1/2005 Di Paola et al. ..... 416/220 R
6,942,462 B1 * 9/2005 Breakwell et al. ..... 416/245 R

FOREIGN PATENT DOCUMENTS

GB 1 213 408 SP 11/1970
GB 2 021 206 A 11/1979
GB 2262139 A * 6/1993
GB 2 267 318 A 12/1993

* cited by examiner

*Primary Examiner*—Christopher Verdier
(74) *Attorney, Agent, or Firm*—W. Warren Taltavull; Manelli Denison & Selter PLLC

(57) ABSTRACT

A gas turbine engine fan blade (22) and disk assembly (30) is provided with levers (36) with which to apply a force to the radially inner end of respective blades (22) so as to move the roots (26) of the blades (22) into abutting engagement with the side walls of the inverted "V" shaped grooves (32) in the disk rim (34), and thereby prevent relative wearing movement therebetween. The levers (36) are appropriately moved by rotation of respective screws (52) that pass through exposed ends thereof in screw threaded engagement, and abut a fixed land (46) so as to apply a pivoting force on each lever (36).

6 Claims, 2 Drawing Sheets

FAN BLADE AND DISK ASSEMBLY

FIELD OF THE INVENTION

The present invention relates to a fan blade and disk assembly, e.g. of the kind utilised in a ducted fan gas turbine engine. Such assemblies include means by which a permanent load is applied to the radially inner end extremities of the blades, so as to urge their root portions in a direction radially outwards of the axis of rotation of the assembly, into engagement with abutments in the walls of grooves in the disk rim. By this means, any slack that exists between the abutments and blade root portions due to machining tolerances is obviated. Friction and therefore wear of the engaging surfaces is thus substantially reduced.

BACKGROUND OF INVENTION

It is known from published patent specification GB.2,262,139 to apply a permanent load to the radially inner ends of an assembly of fan blades on a disk. It is achieved by cranked rods, one end portion of each of which is inserted in the space between the bottom of each respective groove and the radially inner end of the associated blade, in engagement with both, and the other end of which projects from the groove and is acted upon by a force ring. The latter is clamped via an inner flange to the disk, and the clamping force causes the ring to spread in the radial sense. An outer lip thus presses on the outer end of the cranked rod, which pivots about its inner end portion in a radially outwards direction, and thereby applies the required permanent force to the radially inner end of each blade.

SUMMARY OF THE INVENTION

The present invention seeks to provide a fan blade and disk assembly including an improved blade moving force means.

According to the present invention a fan blade and disk assembly includes means with which a force is applied to the inner end of each blade so as to permanently force them radially outwardly of the axis of rotation of the assembly so as to engage abutments on the walls of grooves in the rim of said disk in which the root portions of said blades reside, wherein said force applying means comprises levers, a substantial portion of each of which is positioned in a space defined between the radially inner end of a respective blade and the bottom of an associated groove, an intermediate portion is arched, and the remaining projects outside of said space and has a screw passing through it in screw threaded engagement therewith, so as to abut a land formed on a face of said disk and, by further rotation, thus cause said lever to pivot about its inner end portion extremity to bring said arched portion into contact with the radially outwards

BRIEF DESCRIPTION OF THE DRAWINGS

The present invention will now be described, by way of example and with respect to the accompanying drawings, in which.

DETAILED DESCRIPTION OF THE INVENTION

Figure 1:
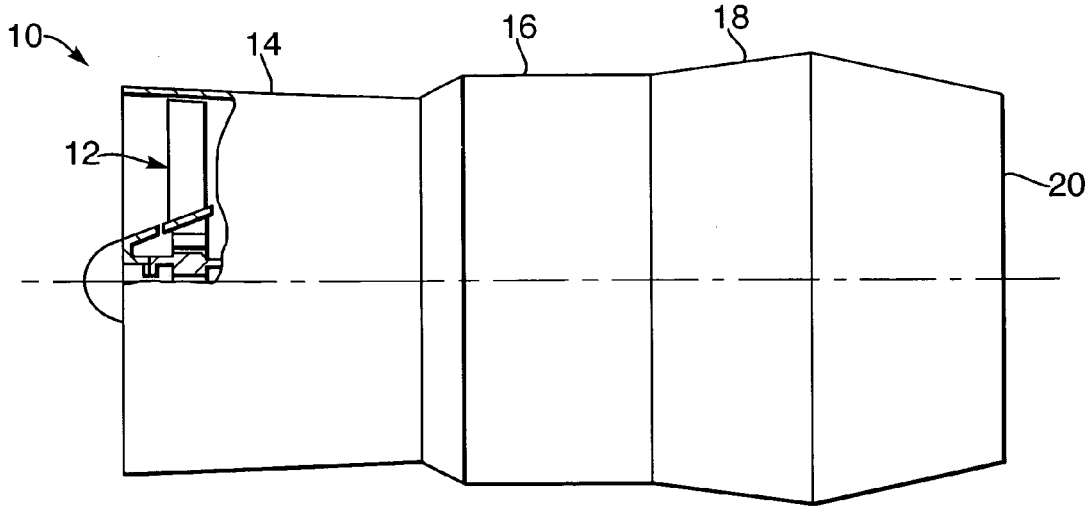
FIG. 1 is a diagrammatic view of a ducted fan gas turbine engine of the kind in which the present invention can be incorporated.

Referring to FIG. 1. Ducted gas turbine engine 10 has a fan stage 12, a compressor stage 14, a combustion system 16, a turbine stage 18, and an exhaust nozzle 20.

Figure 2:
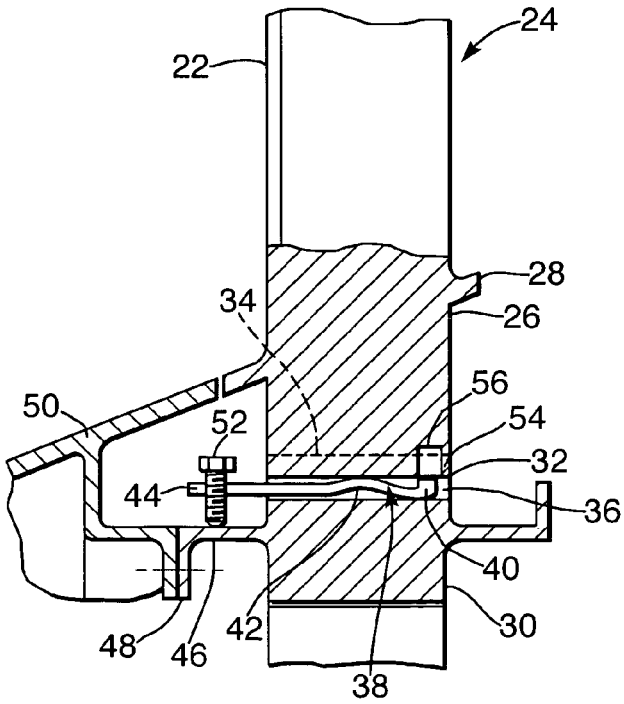
FIG. 2 is an enlarged cross sectional part view of the ducted fan gas turbine engine in FIG. 1 including the present invention.
Figure 3:
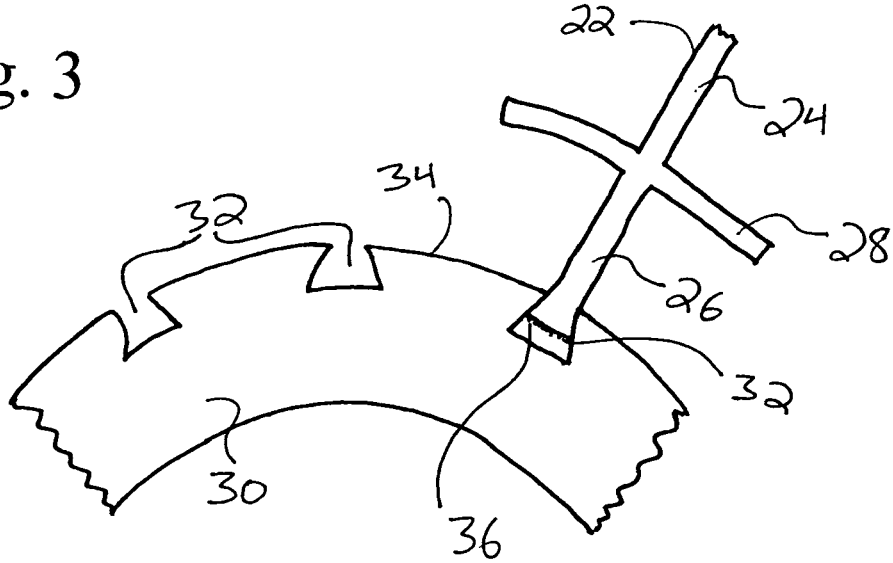
FIG. 3 is an enlarged sectional view of a dovetail groove in the rim of the disc of the present invention.
Figure 4:
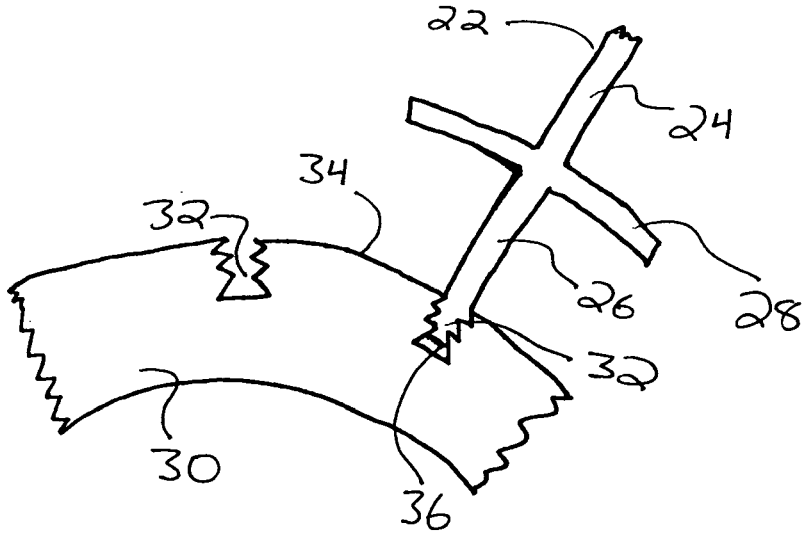
FIG. 4 is an enlarged sectional view of a fir tree groove in the rim of the disc of the present invention.

Referring to FIG. 2. Each fan blade 22 of fan stage 12 in FIG. 1 has an aerofoil 24 and a root 26, separated, one from the other by a platform 28 in known manner. From hereon only one fan blade 22 will be described, on the understanding that the description applies to all of the fan blades in the stage 12.

Fan blade root 26 is in the form of an inverted "V" in known manner, and the fan disk 30 is provided with a groove 32 (not shown in its entirety) in its rim 34, which groove is complementary in shape to root 26, but deeper than root 26. A space 36 is thus created therebetween by action of centrifugal forces when fan stage 12 is operatively rotating. These features are known art.

Clearly, if fan stage 12 does not rotate fast enough, fan blades 22 will slop about with resulting frictional wear occurring on the root and groove walls. Therefore, on assembly of the root 26 of blade 22 into groove 32 in disk 30, fan blade 22 is pushed radially outwards by hand, and a lever 38 is inserted in the resulting space 36. The inner end portion 40 of lever 38 is positioned near the end of groove 32. The intermediate portion 42 of lever 38 is arched towards the inner end of fan blade root 26. The outer end 44 of lever 38 projects beyond the face of disk 30 and over an annular land 46 which carries a flange 48, to which a nose cone 50 is bolted as a last step in the assembly. The outer end 44 of lever 38 is drilled and tapped and a screw 52 is inserted and screwed through lever 38 until it engages land 46. Movement of screw 52 is continued, which causes a reverse reaction between the threads of screw 52 and tapped drilling. This in turn, results in lever 38 effectively climbing screw 52 and pivoting about its inner end 40 so that arched position 42 of lever 38 engages the inner end of root 26. Screwing is still continued until lever 38, via arched portion 42, has raised fan blade 22 in groove 32 sufficiently to achieve firm engagement of the flanks of groove 32 by the flanks of root 26. Relative movement therebetween is thus avoided.

The utilisation of screws as the force applying means provides an advantage over the disclosed prior art, in that it obviates the need for a completely annular force ring, thus achieving a weight reduction. Moreover, the drilling and tapping of lever 38 further reduces weight, and the force reactor on screw 52 is a flanged land that is an existing parts, i.e. it is there to receive the nose cone 50 directly on to it, with or without inclusion of the present invention.

The lever arrangement of the present invention provides a further advantage as follows. In order that lever 38 has sufficient rigidity to move and then hold fan blade 22 in its desired position, it must have some bulk. The bulk enables the inner end extremity 40 of lever 38 to have a flat 54 formed on it, which flat is located radially inwards of a shear key 56 that bridges the inner end of root 26 and the rim 34 of disk 30. The shear key 56 is thus prevented from falling out of engagement with the root 26 into groove 32 in disk 30. Shear key 56 may thus be made shorter than hitherto.

As described so far, the inverted V shape or dovetail shape of the groove walls act as abutments. However, known fir tree abutments of the kind commonly used on the roots of turbine blades, can be provided.

Also the present invention is applicable to fan blades which do not have platforms.

I claim:

1. A fan blade and disk assembly having an axis of rotation and comprising a disk and a plurality of fan blades, each fan blade having a root portion, the disk having a rim and a land formed on a face of the disk, the rim having a plurality of grooves to receive the root portions of the fan blades, the grooves comprise walls, bottoms and abutments, and including means with which a force is applied to the inner end of the root portion of each fan blade so as to permanently force each fan blade radially outwardly of the axis of rotation of the assembly so as to engage abutments on the walls of grooves in the rim of said disk in which the root portions of said fan blades reside, wherein said force applying means comprises levers, a first portion of each lever is positioned in a space defined between the radially inner end of the root portion of each respective blade and the bottom of an associated groove, a second portion of each lever is arched, and a third portion of each lever projects outside said space and has a screw passing through said third portion of each lever in screw threaded engagement with said third portion so as to abut the land formed on the face of said disk and, by further rotation, thus cause said lever to pivot about its first portion to bring said arched second portion into contact with the radially inner end of the root portion of its respective fan blade and force said root portion radially outwards into the groove wall abutments of the disk.

2. A fan blade and disk assembly as claimed in claim 1 wherein the groove walls provide said abutments.

3. A fan blade and disk assembly as claimed in claim 1 wherein fir tree abutments are provided on the groove walls.

4. A fan blade and disk assembly as claimed in claim 1 wherein dovetail abutments are provided on the groove walls.

5. A fan blade and disk assembly as claimed in claim 1 wherein said land includes an annular flange for attachment of a nose bullet to said annular flange.

6. A fan blade and disk assembly as claimed in claim 1 wherein shear keys bridge the inner ends of the root portions of the fan blades and the rim of the disk, the first portion of each lever is located radially between the shear key and the bottom of the respective groove in the disk.

* * * * *